US011125057B2

(12) United States Patent
Robey

(10) Patent No.: US 11,125,057 B2
(45) Date of Patent: Sep. 21, 2021

(54) DOWNHOLE PERFORATOR HAVING REDUCED FLUID CLEARANCE

(71) Applicant: Halliburton Energy Services, Inc., Houston, TX (US)

(72) Inventor: Richard Ellis Robey, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/478,378

(22) PCT Filed: Apr. 19, 2017

(86) PCT No.: PCT/US2017/028414
§ 371 (c)(1),
(2) Date: Jul. 16, 2019

(87) PCT Pub. No.: WO2018/194593
PCT Pub. Date: Oct. 25, 2018

(65) Prior Publication Data

US 2019/0368320 A1 Dec. 5, 2019

(51) Int. Cl.

| | |
|---|---|
| ***E21B 43/11*** | (2006.01) |
| ***E21B 43/119*** | (2006.01) |
| ***E21B 43/117*** | (2006.01) |
| ***E21B 43/118*** | (2006.01) |

(52) U.S. Cl.
CPC ..... *E21B 43/119* (2013.01); *E21B 43/117* (2013.01); *E21B 43/118* (2013.01)

(58) Field of Classification Search
CPC ..... E21B 43/117; E21B 43/118; E21B 43/119
See application file for complete search history.

(56) References Cited

U.S. PATENT DOCUMENTS

| | | | | |
|---|---|---|---|---|
| 2,690,123 A * | 9/1954 | Kanady | E21B 43/117 175/4.52 |
| 2,760,435 A * | 8/1956 | Jones | E21B 43/117 175/4.52 |
| 4,961,365 A * | 10/1990 | Rytlewski | E21B 43/118 175/4.53 |
| 5,095,801 A | 3/1992 | Lopez De Cardenas | |
| 5,324,304 A | 6/1994 | Rasmussen | |

(Continued)

FOREIGN PATENT DOCUMENTS

| | | |
|---|---|---|
| WO | 2014182304 A1 | 11/2014 |
| WO | 2018144021 A1 | 8/2018 |

OTHER PUBLICATIONS

International Application No. PCT/US2017/028414, International Search Report dated Jan. 2, 2018, 3 pages.

(Continued)

*Primary Examiner* — Christopher J Sebesta
(74) *Attorney, Agent, or Firm* — Gilliam IP PLLC

(57) ABSTRACT

An apparatus comprises a first cluster of perforator guns positioned circumferentially around a central longitudinal axis at a first axial position, wherein the first cluster is configured in a closed position while the apparatus is being lowered to a perforator position in a wellbore. After the apparatus is lowered to the perforator position, the first cluster is to move to an expanded position such that the perforator guns are moved closer to a target that is to be perforated.

20 Claims, 11 Drawing Sheets

(56) References Cited

U.S. PATENT DOCUMENTS

| | | | | |
|---|---|---|---|---|
| 7,997,353 | B2 | 8/2011 | Ochoa | |
| 7,998,164 | B2 | 8/2011 | Saholt et al. | |
| 2001/0001984 | A1 | 5/2001 | Van Petegem et al. | |
| 2010/0012312 | A1* | 1/2010 | Ochoa | E21B 43/103 166/55.8 |
| 2013/0255950 | A1* | 10/2013 | Richards | E21B 43/1185 166/297 |
| 2015/0176392 | A1 | 6/2015 | Corre | |
| 2015/0176406 | A1* | 6/2015 | Corre | E21B 49/088 166/250.01 |
| 2016/0108708 | A1 | 4/2016 | Al-Gouhi | |
| 2017/0114622 | A1* | 4/2017 | Umphries | E21B 43/117 |

OTHER PUBLICATIONS

International Application No. PCT/US2017/028414, Written Opinion dated Jan. 2, 2018, 10 pages.
European Application Serial No. EP17906520.6; Extended European Search Report; dated Oct 22, 2020, 7 pages.

* cited by examiner

DOWNHOLE PERFORATOR HAVING REDUCED FLUID CLEARANCE

BACKGROUND

The disclosure generally relates to the field of hydrocarbon production, and more particularly to perforating wellbores.

During hydrocarbon production, selective establishment of fluid communication can be created between the interior of a tubular string, such as a casing, liner, tubing, or the like, and the annulus surrounding the tubular string. Communication can be established by creating one or more tubular perforations. Typically, high-explosive, shaped charges can be used to create the perforations. The shaped charges can be detonated at a selected location downhole, creating a jet of hydrodynamically formed material which penetrates the tubular string, thereby forming an opening.

BRIEF DESCRIPTION OF THE DRAWINGS

Embodiments of the disclosure may be better understood by referencing the accompanying drawings.

DESCRIPTION

Figure 1:
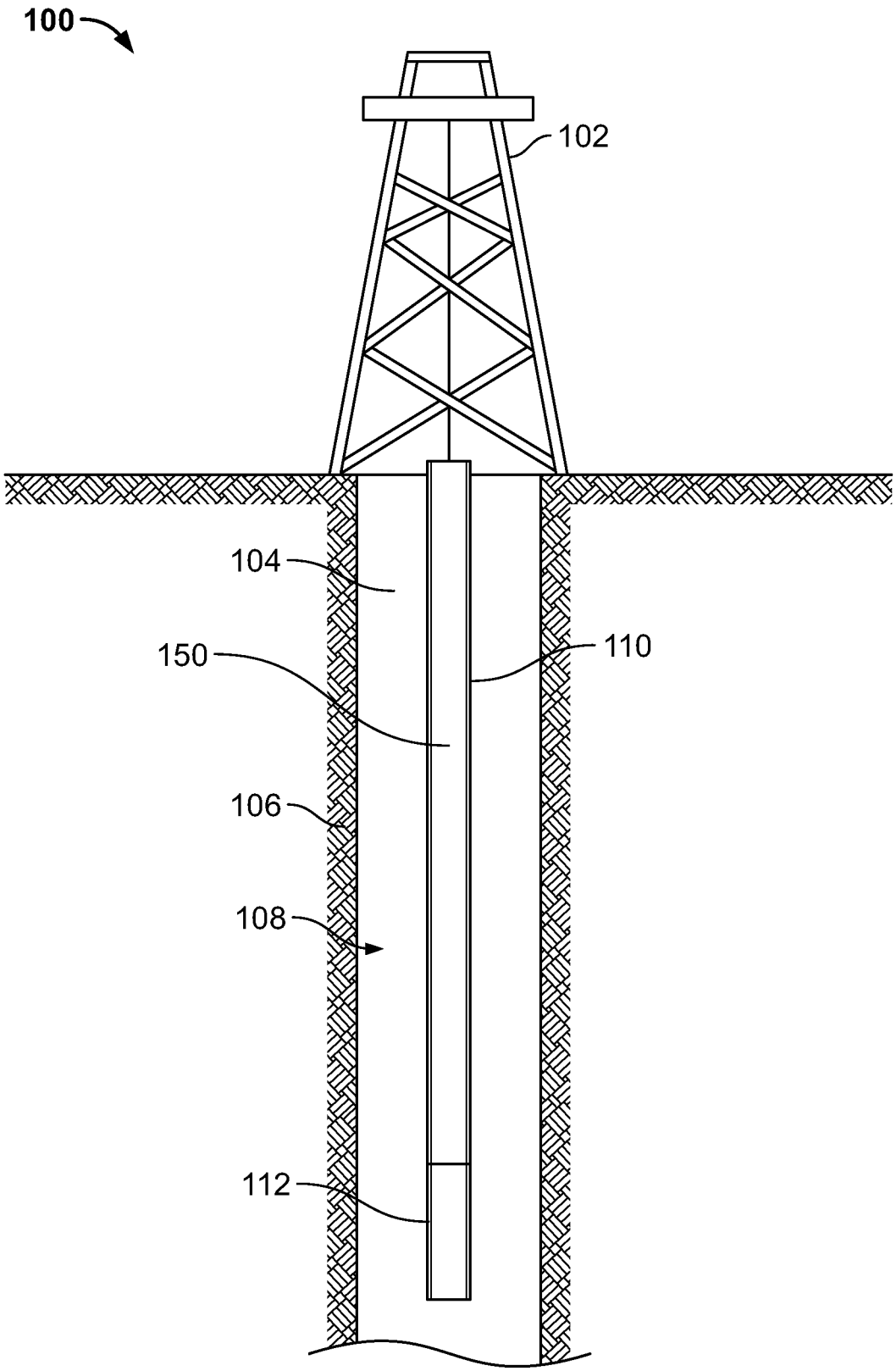
FIG. 1 depicts an example system that includes a perforator tool, according to some embodiments.

The description that follows includes example systems, apparatuses, and methods that embody aspects of the disclosure. However, it is understood that this disclosure may be practiced without these specific details. For instance, this disclosure refers to perforations of wellbores for hydrocarbon production in illustrative examples. Aspects of this disclosure can be also applied to any other perforating applications. In other instances, well-known instruction instances, structures and techniques have not been shown in detail in order not to obfuscate the description.

Various embodiments include perforator tools to perforate wellbores as part of hydrocarbon production and recovery. For example, a perforator tool, according to some embodiments, can be used in a wellbore to create holes in casings or other tubulars to provide a path for fluid flow. Alternatively or in addition, such a perforator tool can also be used to penetrate a formation surrounding a wellbore. Some embodiments provide for increased explosive packaging, lowered fluid gaps or clearance, and high flow areas. Example downhole applications that can leverage these features include perforating for abandonment of a well, wellbore restrictions above the perforating interval, and laminated reservoirs. For example, extremely high flow areas in casing can be needed for a wash and cementing process before abandoning a well.

In some embodiments, a perforator tool can include at least one cluster of perforator guns at a first axial position. The cluster can be configured in a closed position while the perforator tool is being lowered to a perforator position in a wellbore. The perforator tool can be lowered to the defined depth (the perforator position) using wireline, slickline, coil or traditional tubing, etc. The perforator guns can be circumferentially positioned around a central member that is expandable.

Once at the defined depth, the cluster can be articulated to expand the perforator guns outward to the target to be perforated (e.g., the surrounding surface of the wellbore). For example, the target can include the casing, the subsurface formation, etc. Accordingly, a diameter of the cluster of perforator guns is increased so that the perforator guns are closer to the target, thereby reducing an amount of fluid gap or clearance between the target and the perforator guns. In some embodiments, positions of the perforator guns can be moved outward such that the perforator guns are near or in contact with the target.

The cluster can be positioned around the central member such that a fixed phase of a perforator gun is aligned to perforate the target at an even division of the number of perforator guns. For example, assume that a perforator gun can be positioned from 0-360 degrees around a central member in the perforator tool and that there are nine perforator guns in the cluster. In this example, the nine perforator guns would have a 40 degree phasing around the central member.

In some embodiments, a perforator tool can include multiple clusters of perforator guns. A first cluster of perforator guns can be at a first axial position, and a second cluster of perforator guns can be at a second axial position, such that the first cluster does not overlap with the second cluster. The perforator guns of the second cluster can be inline or offset in phase relative to the perforator guns of the first cluster. For example, the first and second clusters can have the same number of perforator guns, wherein the second cluster is inline with the first cluster. Thus, the perforator guns of the second cluster can be defined by the even division that was also used to position the perforator guns of the first cluster. In this example, the perforator guns of the first and second clusters can be aligned, therefore, have a same phasing around the central member. The first and second clusters can be mechanically joined using timed threads, threads with a secondary locking collar or a multitude of methods between the central members.

In another example, the first and second clusters can again have the same number of perforator guns. Similar to the previous example, the perforator guns of the second cluster can be defined by the even division that was also used to position the perforator guns of the first cluster. However, in this example, the perforator guns of the second cluster are arranged to be out of phase with the perforator guns of the first cluster. The phase offset can vary between one degree and the division increment of the first cluster. To illustrate, where the perforator guns of the first cluster have a 40 degree phasing, the phase offset of the perforator guns of the second cluster can be between 1 and 39 degrees. Again, the two clusters can be mechanically joined using timed threads, threads with a secondary locking collar or a multitude of methods between the central members. In some embodiments, the two clusters can be joined to maintain a non-zero degree alignment between the tubular assemblies of the two clusters. Additionally traditional threads can be used on the central members, resulting in a randomized orientation between the first and second central members and thus the clusters.

After the perforator tool is at a position downhole where perforating is to occur, the first and second clusters of perforator guns can be expanded out from the central member to an expanded position at a second radial position. For instance, the first and second clusters of perforator guns can be expanded to a second radial position to be near or in contact with the target.

Each perforator gun can include one or more explosive charges that may be triggered to detonate, perforating a casing, if present, a wall of the wellbore, and/or forming perforation tunnels in the subterranean formation. For example, each perforator gun can have an individual detonating train that initiate charges aimed outward towards the target (e.g., nearest surface of the casing). Also, a central firer can detonate the explosive detonating trains for the perforator guns in the perforator tool. The central firer can simultaneously detonate the explosive detonating trains. Alternatively, the central firer can sequentially delay the explosive detonating trains across all perforator guns in the perforator tool, all perforator guns in one cluster, etc.

Thus, individual hollow carrier guns can be articulated outward to be near or in contact the casing or exposed formation. Accordingly, various embodiments allow for explosion of the shaped charges to be applied to the casing or exposed formation without having to overcome excessive fluid clearance. In some instances, the perforator tool can be configured to create fluid clearances in the optimum range for a given charge and target scenario.

Example System

FIG. 1 depicts an example system that includes a perforator tool, according to some embodiments. As illustrated in FIG. 1, a wellbore servicing system 100 comprises a servicing rig 102 that extends over and around a wellbore 104 that penetrates a subterranean formation 14. The wellbore 104 may be used to recover hydrocarbons, store hydrocarbons, dispose of various fluids (e.g., recovered water, carbon dioxide, etc.), recover water (e.g., potable water), recover geothermal energy, or the like. The wellbore 104 may be drilled into the subterranean formation 106 using any suitable drilling technique. While shown as extending vertically from the surface in FIG. 1, in some embodiments the wellbore 104 may be horizontal, deviated at any suitable angle, and/or curved over one or more portions of the wellbore 104. The wellbore 104 generally comprises an opening disposed in the earth having a variety of shapes and/or geometries, and the wellbore 104 may be cased, open hole, and/or lined.

The servicing rig 102 may be one of a drilling rig, a completion rig, a workover rig, a servicing rig, or other mast like structure and may support a wellbore tubular string 108 in the wellbore 104. In some embodiments, a different structure may support the wellbore tubular string 108, for example an injector head of a coiled tubing rig. In some embodiments, the servicing rig 102 may comprise a derrick with a rig floor through which the wellbore tubular string 108 extends downward from the servicing rig 102 into the wellbore 104. In some embodiments, such as in an off-shore location, the servicing rig 102 may be supported by piers extending downwards to a seabed. The servicing rig 102 can be supported by columns sitting on hulls and/or pontoons that are ballasted below the water surface, which may be referred to as a semi-submersible platform or rig. In an off-shore location, a casing may extend from the servicing rig 102 to exclude seawater. It should be understood that other conveyance mechanisms may control the run-in and withdrawal of the wellbore tubular string 108 in the wellbore 104, for example draw works coupled to a hoisting apparatus, a slickline unit, a wireline unit (e.g., including a winching apparatus), another servicing vehicle, a coiled tubing unit, and/or any other suitable apparatus.

The wellbore tubular string 108 can comprise any of a variety of wellbore tubulars 110, a perforator tool 112, and optionally, other tools and/or subassemblies located above and/or below the perforator tool 112. The wellbore tubulars 110 may comprise any type of work string or production string, including, but not limited to production string, string of jointed pipes, slickline, electric wire-line, coiled tubing, and other types of conveyances known in the drilling, completing or logging arts for conveying tools such as perforator tool 112 down into a wellbore.

In some embodiments, the perforator tool 112 can comprise one or more clusters of perforator guns (described in more detail below). Each perforator gun can include one or more explosive charges that may be triggered to detonate, perforating a casing, if present, a wall of the wellbore 104, and/or forming perforation tunnels in the subterranean formation 106. Perforating may allow for the recovery of fluids such as hydrocarbons from the subterranean formation 106 for production at the surface, storing fluids (e.g., hydrocarbons, aqueous fluids, etc.) flowed into the subterranean formation 106, and/or disposed on various fluids in the subterranean formation 106.

The perforator tool 112 may comprises a plurality of shaped charges. Generally, explosive charge assemblies utilized as well perforating charges include a generally cylindrical or cup-shaped housing having an open end, within which is mounted a shaped explosive generally configured as a hollow cone having its concave side facing the open end of the housing. The concave surface of the explosive is lined with a thin metal liner which is explosively driven to hydrodynamically form a jet of material with fluid-like properties upon detonation of the explosive. This jet of viscous material exhibits a good penetrating power to pierce the well pipe, its concrete liner and the surrounding earth formation. Typically, the explosive charge assemblies are configured so that the liners along the concave surfaces thereof define simple conical liners with a small radius apex at a radius angle of from about 5 degrees to about 60 degrees. Other charges have an apex with a hemispherical, a half-ellipse, a portion of a parabola, a portion of a hyperbola, a half circle, a cone, a frusto-conical shape, or some other shape fitted with a liner of uniform thickness.

Generally, explosive materials such as HMX, RDX, PYX, or FINS are coated or blended with binders such as wax or synthetic polymeric reactive binders such as that sold under the trademark KEL-F. The resultant mixture is cold- or hot-pressed to approximately 90% of its theoretical maximum density directly into the explosive charge assembly case. The resulting explosive charge assemblies are initiated by means of a booster or priming charge positioned at or near the apex of the explosive charge assembly and located so that a detonating fuse, detonating cord or electrical detonator may be positioned in close proximity to the priming charge.

Explosive charge assemblies may be designed as either deep-penetrating charges or large-diameter hole charges. Generally, explosive charge assemblies designed for use in perforating guns may contain 5 to 60 grams of high explosive and those designed as deep-penetrating charges may typically penetrate concrete from 10 inches to over 50 inches. Large-diameter hole explosive charge assemblies for perforating guns may create holes on the order of about one inch in diameter and display concrete penetration of up to about 9 inches.

Each perforator gun in the perforator tool 112 can include one or more explosive charges that may be triggered to detonate, perforating a casing, if present, a wall of the wellbore 104, and/or forming perforation tunnels in the subterranean formation 106. For example, each perforator gun can have an individual detonating train that initiate charges aimed outward towards the target (e.g., nearest surface of the casing). Each perforator gun in a cluster can have an explosive detonating train that is independent of detonating trains in other perforator guns in the perforator tool. In some embodiments, each perforator gun can be within an individually sealed hollow carrier, wherein each perforator gun can include explosive shaped charges that are detonated during perforation. Also, a central firer 150 can detonate the explosive detonating trains for the perforator guns in the perforator tool. In this example, the central firer 150 is positioned near the surface in the wellbore tubulars 110. However, the central firer 150 can be positioned at other locations. For example, the central firer 150 can be positioned in or near the perforator tool 112, at some location above the surface, etc. The central firer 150 can simultaneously detonate the explosive detonating trains. Alternatively, the central firer 150 can sequentially delay the explosive detonating trains across all perforator guns in the perforator tool, all perforator guns in one cluster, etc.

Perforator Tool Examples

FIGS. 2-5 depict an example perforator tool having one cluster of perforator guns. FIGS. 6-9 depict an example perforator tool having multiple clusters of perforator guns.

Figure 2:
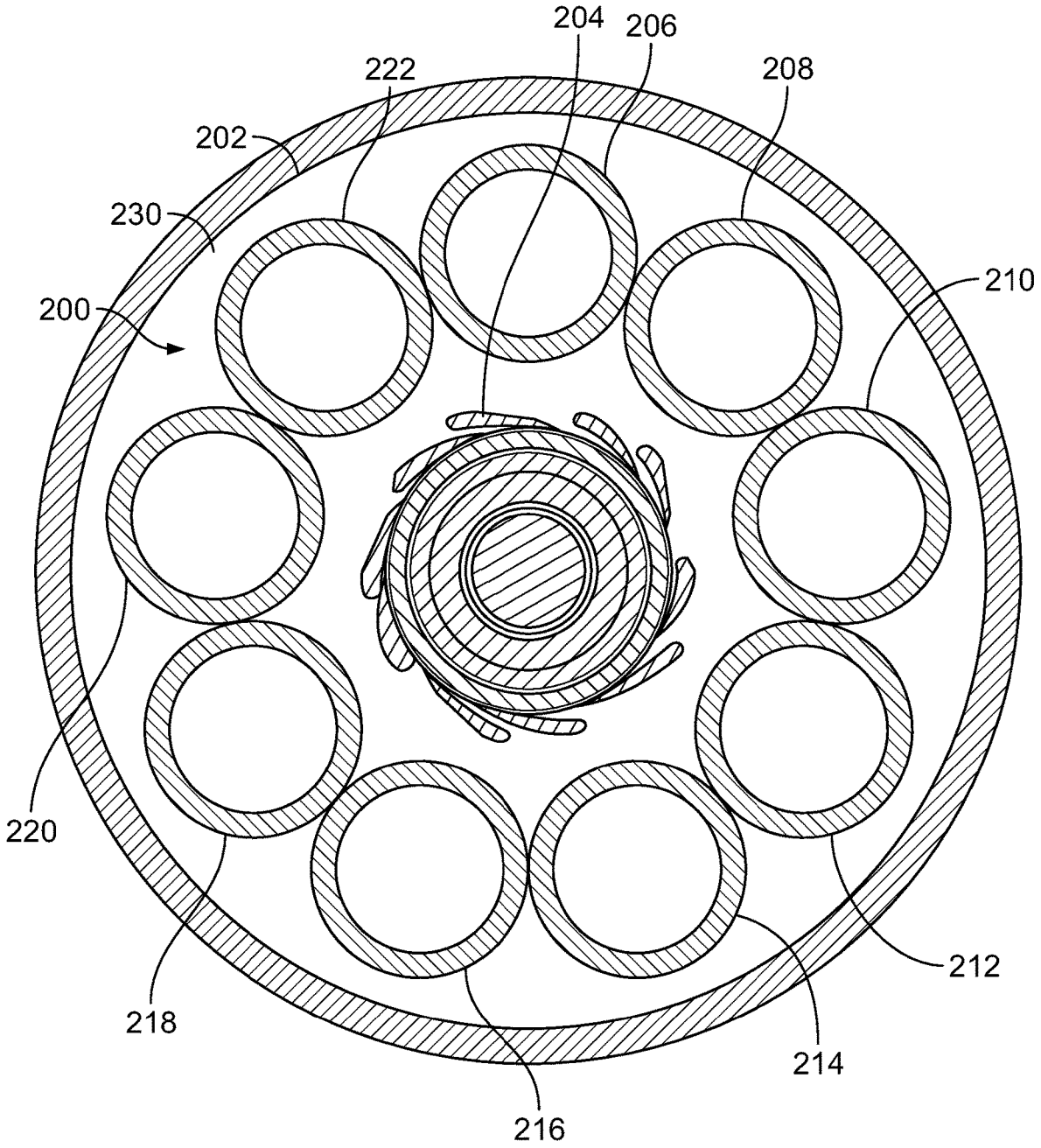
FIG. 2 depicts a cross section of a cluster of perforator guns in a closed position, according to some embodiments.

FIG. 2 depicts a cross section of a cluster of perforator guns in a closed position, according to some embodiments. FIG. 2 depicts a cross section of a cluster 200 within a casing 202 of a wellbore. With reference to FIG. 1, the cluster 200 may be part of the perforator tool 112 positioned in the wellbore 104. In some applications, the wellbore may or may not include casing. For example, 202 can be the surrounding subsurface formation instead of the casing around the wellbore. The cluster 200 includes perforator guns 206, 208, 210, 212, 214, 216, 218, 220, and 222. The number of perforator guns in a cluster can be less or more than the example of nine depicted in FIG. 2. Each perforator gun can be within an individually sealed hollow carrier, wherein each perforator gun can include explosive shaped charges that are detonated during perforation, as further described below. Also, one or more similar clusters may be positioned above or below the cluster 200 in a perforator tool, as further described below.

As depicted in FIG. 2, the cluster 200 is in a closed position, which can be defined as a first radial position. While in the closed position, a fluid gap (clearance) 230 is defined between the inner wall of the casing 202 and the perforator guns 206-222. A central member 204 can be in the center of the cluster 200. The central member 204 can include diametrically expandable tool to move the perforator guns 206-222 outward toward the casing 202 into an expanded position (a second radial position), as further described below. In some embodiments, the perforator guns 206-222 can be circumferentially positioned at a first equal angular spacing around the central member 204. While in the closed position, the perforator guns 206-222 can be near or in contact with the central member 204. Also, while in the closed position, each of the perforator guns 206-222 can be near or in contact with the two adjacent perforator guns. For example, the perforator gun 206 can be in contact with the perforator gun 208 and 222. The perforator guns 208 and 210 can be in contact with each other. The perforator guns 210 and 212 can be in contact with each other. The perforator guns 212 and 214 can be in contact with each other. The perforator guns 214 and 216 can be in contact with each other. The perforator guns 216 and 218 can be in contact with each other. The perforator guns 218 and 220 can be in contact with each other. The perforator guns 220 and 222 can be in contact with each other.

Figure 3:
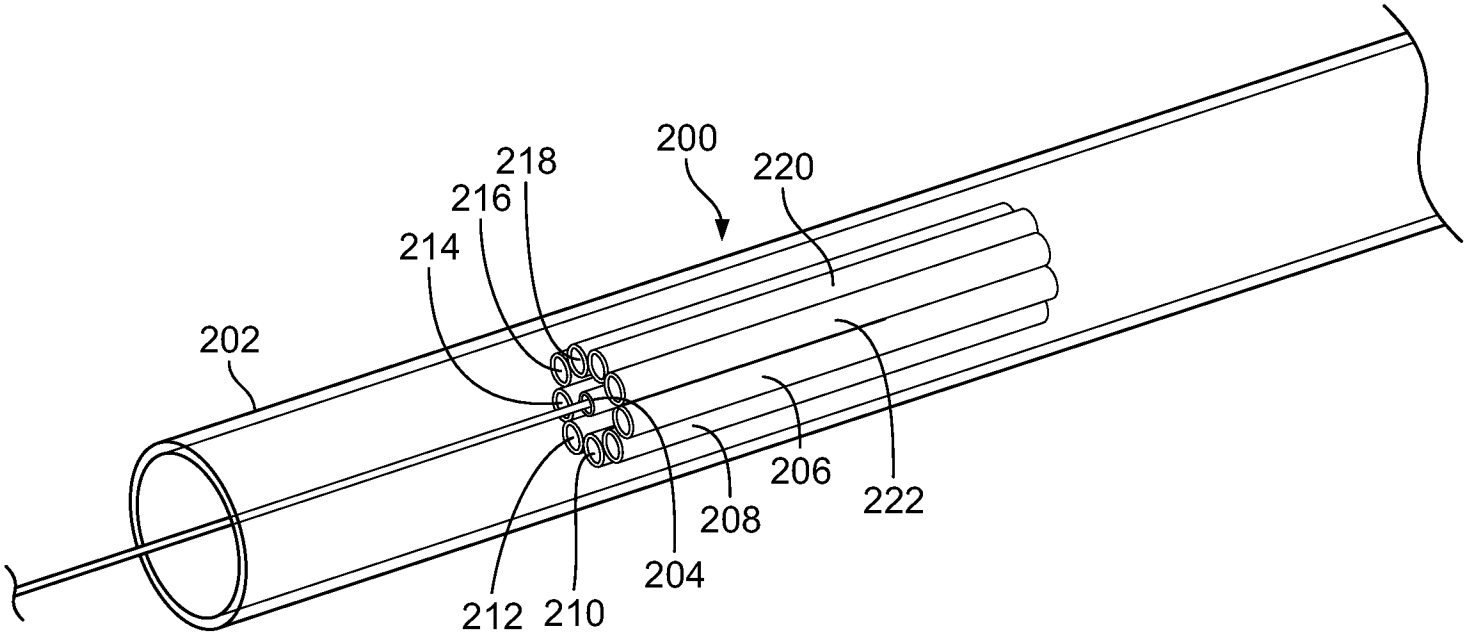
FIG. 3 depicts the cluster of perforator guns of FIG. 2 in the closed position while being lowered into a wellbore, according to some embodiments.

FIG. 3 depicts the cluster of perforator guns of FIG. 2 in the closed position while being lowered into a wellbore, according to some embodiments. As shown, each of the perforator guns 206-222 of the cluster 200 can be within an individually sealed hollow carrier, wherein each perforator gun can include explosive shaped charges that are detonated during perforation, as further described below.

Figure 4:
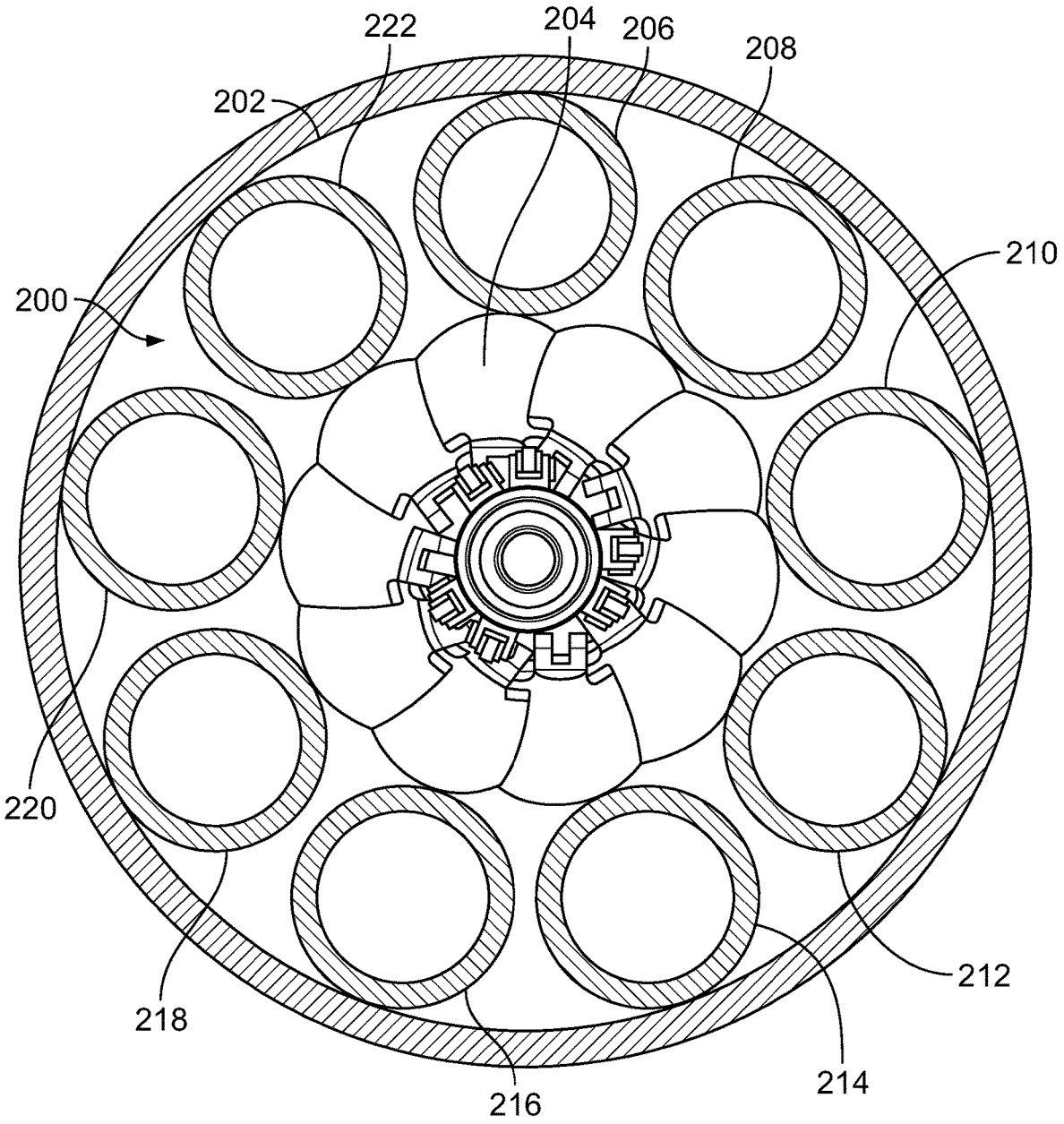
FIG. 4 depicts a cross section of the cluster of perforator guns of FIG. 3 in an expanded position, according to some embodiments.
Figure 5:
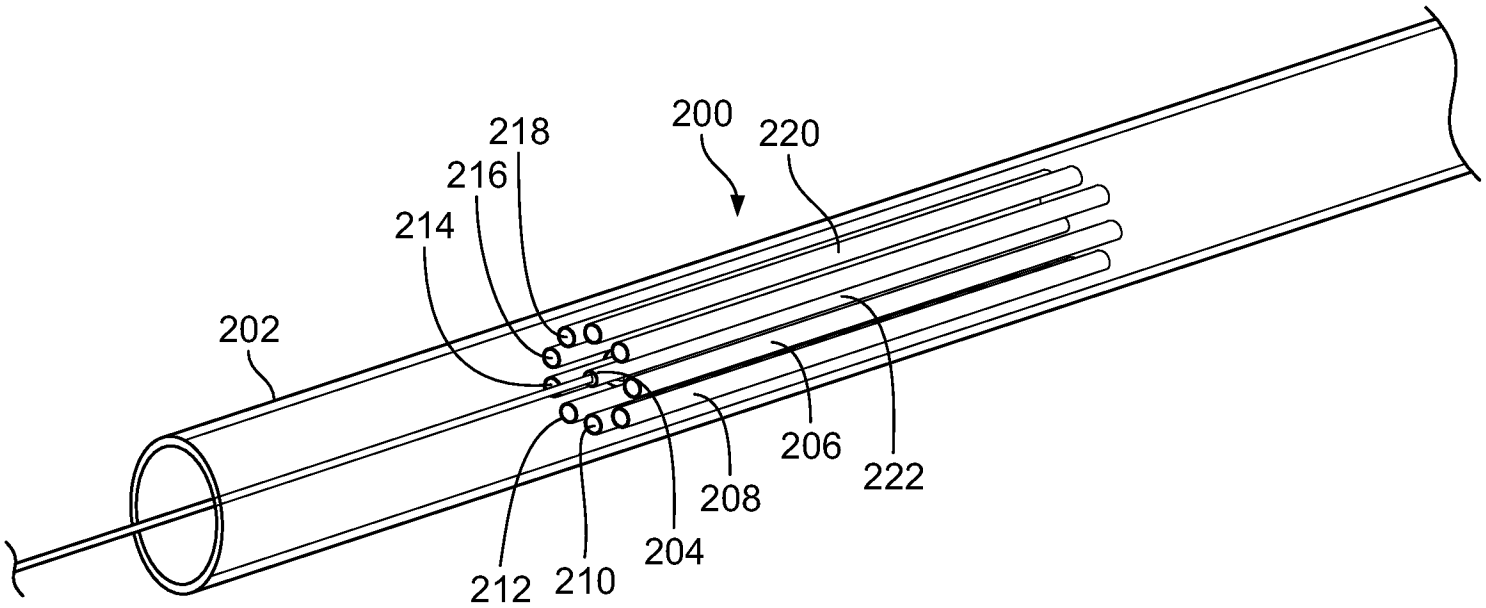
FIG. 5 depicts the cluster of perforator guns of FIG. 4 in the expanded position in the wellbore, according to some embodiments.

FIGS. 4-5 depict movements and positions of the cluster 200 after the perforator tool has been lowered to a positioned in the wellbore where perforation is to occur. FIG. 4 depicts a cross section of the cluster of perforator guns of FIG. 3 in an expanded position, according to some embodiments. FIG. 5 depicts the cluster of perforator guns of FIG. 4 in the expanded position in the wellbore, according to some embodiments.

In contrast to the central member 204 in the closed position depicted in FIG. 2, the central member 204 in FIG. 4 has been moved to an expanded position to move the perforator guns for the cluster 200 into their expanded position near the casing 202. While in the expanded position, the fluid gap 230 depicted in FIG. 2 is now essentially eliminated between the inner wall of the casing 202 and the perforator guns 206-222 of the cluster 200.

Figure 6:
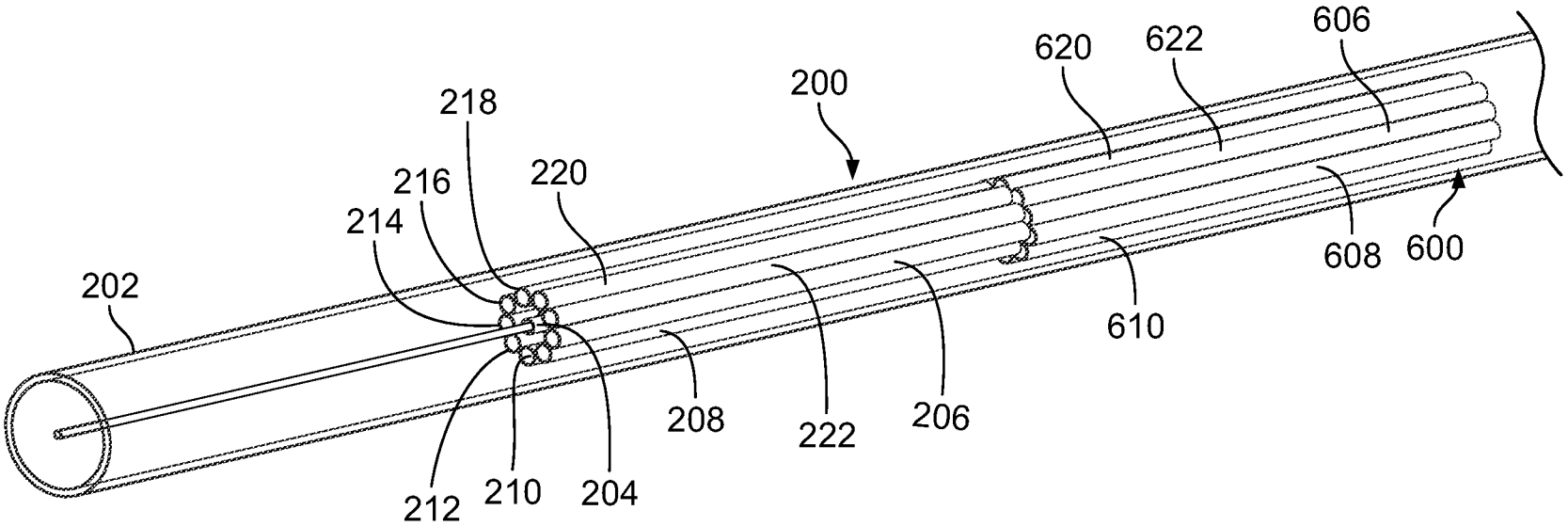
FIG. 6 depicts two clusters of perforator guns, wherein both clusters are in the closed position while being lowered into a wellbore, according to some embodiments.

FIGS. 6-9 depict an example perforator tool having multiple clusters of perforator guns. FIG. 6 depicts two clusters of perforator guns, wherein both clusters are in the closed position while being lowered into a wellbore, according to some embodiments.

Figure 7:
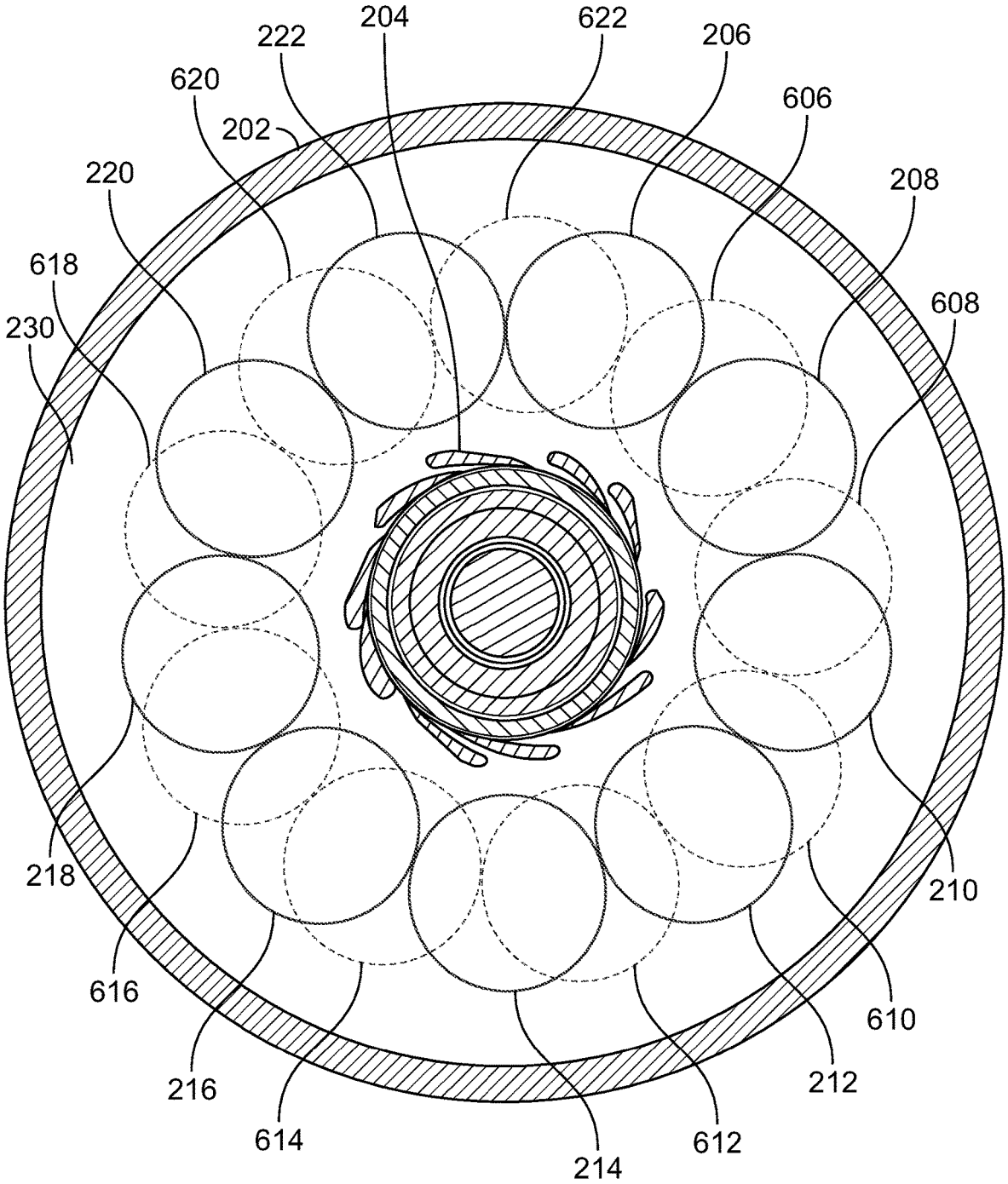
FIG. 7 depicts a cross section of two clusters of perforator guns of FIG. 6 in a closed position with perforator guns in one cluster being aligned at a phase offset relative to perforator guns of the other cluster, according to some embodiments.

In this example, FIG. 6 depicts the cluster 200 and a cluster 600 positioned in the casing 202 of the wellbore. The clusters 200 and 600 are in two different axial positions along a central longitudinal axis of the central member 204. The cluster 200 is at a first axial position. The cluster 600 is at a second axial position. As described above, the cluster 200 includes nine perforator guns 206-222. Similarly, the cluster 600 can also include nine perforator guns. Because of the viewing angle, FIG. 6 only depicts five of the nine perforator guns for the cluster 600—perforator guns 606, 608, 610, 620, and 622. The four other perforator guns for the cluster 600 include perforator guns 612, 614, 616, and 618. An example of the cluster 600 (relative to the cluster 300) that includes the nine perforator guns (both in the closed position) is depicted in FIG. 7, which is further described below. The perforator guns of the cluster 200 and the cluster 600 are in the closed position.

While in the closed position, the perforator guns in the cluster 300 and the cluster 600 can be near or in contact with the central member 204. Also, while in the closed position, each of the perforator guns of the cluster 300 and the cluster 600 can be near or in contact with the two adjacent perforator guns. For example as described above in reference to FIG. 2, the perforator gun 206 can be in contact with the perforator gun 208 and 222. The perforator guns 208 and 210 can be in contact with each other. The perforator guns 210 and 212 can be in contact with each other. The perforator guns 212 and 214 can be in contact with each other. The perforator guns 214 and 216 can be in contact with each other. The perforator guns 216 and 218 can be in contact with each other. The perforator guns 218 and 220 can be in contact with each other. The perforator guns 220 and 222 can be in contact with each other. With regard to the cluster 600, the perforator gun 606 can be in contact with the perforator gun 608 and 622. The perforator guns 608 and 610 can be in contact with each other. The perforator guns 610 and 612 can be in contact with each other. The perforator guns 612 and 614 can be in contact with each other. The perforator guns 614 and 616 can be in contact with each other. The perforator guns 616 and 618 can be in contact with each other. The perforator guns 618 and 620 can be in contact with each other. The perforator guns 620 and 622 can be in contact with each other.

Each perforator gun in the cluster 300 and the cluster 600 can be within an individually sealed hollow carrier, wherein each perforator gun can include explosive shaped charges that are detonated during perforation, as further described below. In some embodiments, the perforator guns of the cluster 200 can be circumferentially positioned at the first equal angular spacing around the central member 204. The perforator guns of the cluster 600 can also be circumferentially positioned at the first equal angular spacing around the central member 204.

While having a same angular spacing, in some embodiments, the perforator guns in the cluster 200 may or may not have a phase offset to the perforator guns in the cluster 600. In other words, the perforator guns of the cluster 200 can be inline or offset in phase relative to the perforator guns of the cluster 600. For example, the cluster 200 and the cluster 600 can have the same number of perforator guns, wherein the cluster 200 is inline with the cluster 600. Thus, the perforator guns of the cluster 200 can be defined by the even division that was also used to position the perforator guns of the cluster 600. In this example, the perforator guns of the cluster 200 and the perforator guns of the cluster 600 can, therefore, have a same phasing around the central member 204.

In another example, the cluster 200 and the cluster 600 can again have the same number of perforator guns. Similar to the previous example, the perforator guns of the cluster 200 can be defined by the even division that was also used to position the perforator guns of the cluster 600. However, in this example, the perforator guns of the cluster 200 are arranged to be out of phase with the perforator guns of the cluster 600. The phase offset can vary between one degree and the division increment of the cluster 200. For instance, where the perforator guns of the cluster 200 have a 40 degree phasing, the phase offset of the perforator guns of the cluster 600 can be between 1 and 39 degrees. With both clusters 200 and 600 being in a closed position, there is a fluid gap between each cluster and the wall of the casing 202 of the wellbore.

While depicted as having two clusters in this example, in some other embodiments, there can be a greater number of clusters in the perforator tool, wherein each of the different clusters are positioned at different axial positions along the central member 204 in closed positions while the perforator tool is being lowered to the perforator position down the wellbore.

FIG. 7 depicts a cross section of two clusters of perforator guns of FIG. 6 in a closed position with perforator guns in one cluster being aligned at a phase offset relative to perforator guns of the other cluster, according to some embodiments. As described above, perforator guns of one cluster can be inline (having a same phase) or have a phase offset relative to each other relative to perforator guns of a second clusters in a perforator tool. In this example, there is a phase offset. FIG. 7 depicts an example where the perforator guns 206-222 of the cluster 200 are positioned axially above the perforator guns 606-622 of the cluster 600 in the perforator tool. Also, in this example, there are nine perforator guns in each cluster that are positioned at an equal angular spacing 360 degrees (circumferentially) around the central member 204. Thus, assume that the perforator guns 206-222 of the cluster 200 are at a degree phasing of 360/9→40 degrees.

For this example, the perforator guns 606-622 of the cluster 600 are also positioned at an equal angular spacing 360 degrees (circumferentially) around the central member 204. However, the perforator guns 606-622 of the cluster 600 are at a phase offset relative to the perforator guns 206-222 of the cluster 200. Therefore, the phase offset of the perforator guns 606-622 of the cluster 600 can be between 1 and 39 degrees.

As shown, the perforator gun 606 is at a phase offset between the perforator gun 206 and the perforator gun 208. The perforator gun 608 is at a phase offset between the perforator gun 208 and the perforator gun 210. The perforator gun 610 is at a phase offset between the perforator gun 210 and the perforator gun 212. The perforator gun 612 is at a phase offset between the perforator gun 212 and the perforator gun 214.

The perforator gun 614 is at a phase offset between the perforator gun 214 and the perforator gun 216. The perforator gun 616 is at a phase offset between the perforator gun 216 and the perforator gun 218. The perforator gun 618 is at a phase offset between the perforator gun 218 and the perforator gun 220. The perforator gun 620 is at a phase offset between the perforator gun 220 and the perforator gun 222. The perforator gun 622 is at a phase offset between the perforator gun 222 and the perforator gun 206.

Also, in this example, while in the closed position, each perforator gun in the cluster 200 and the cluster 600 are in contact with the central member 204. Additionally, each perforator gun in a given cluster can be in contact with the two adjacent perforator guns. In some other embodiments, while in the closed position, one or more of the perforator guns in the cluster 200 and the cluster 600 may be near or proximate to (but not necessarily in contact with) the central member 204. Additionally, in some other embodiments, while in the closed position, one or more of the perforator guns in the cluster 200 and the cluster 600 may be near or proximate to (but not necessarily in contact with) with the two adjacent perforator guns.

Figure 8:
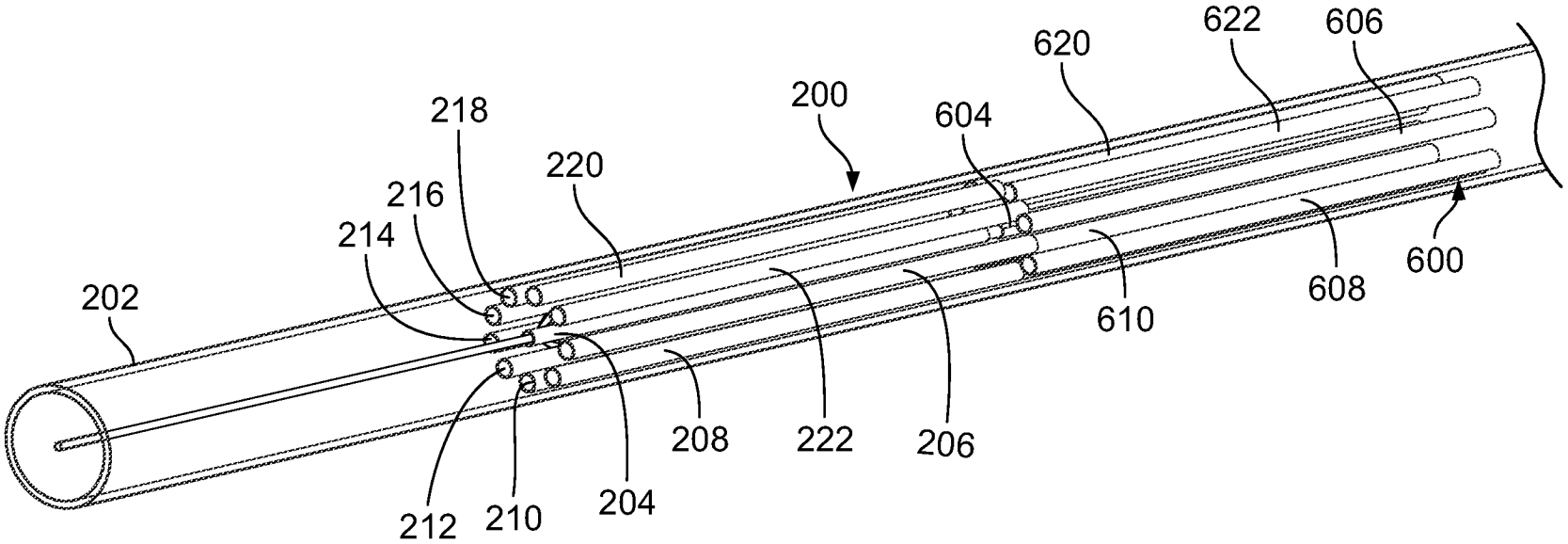
FIG. 8 depicts the two clusters of perforator guns in the wellbore, wherein both clusters are in the expanded position, according to some embodiments.

FIG. 8 depicts the two clusters of perforator guns in the wellbore, wherein both clusters are in the expanded position, according to some embodiments. The perforator guns 206-222 of the cluster 200 are moved to a second radial position (the expanded position). Similarly, the perforator guns 606-622 of the cluster 600 are moved to a second radial position (the expanded position). The radial position of the perforator guns 206-222 may or may not be the same as the radial position of the perforator guns 606-622.

The perforator guns 206-222 of the cluster 200 and the perforator guns 606-622 of the cluster 600 can be moved to the expanded position by articulating an expandable part of the central member 204 that is coupled to the perforator guns. In the expanded position, the perforator guns 206-222 of the cluster 200 and the perforator guns 606-622 of the cluster 600 can be near or in contact with the wall of the casing 202 of the wellbore.

Figure 9:
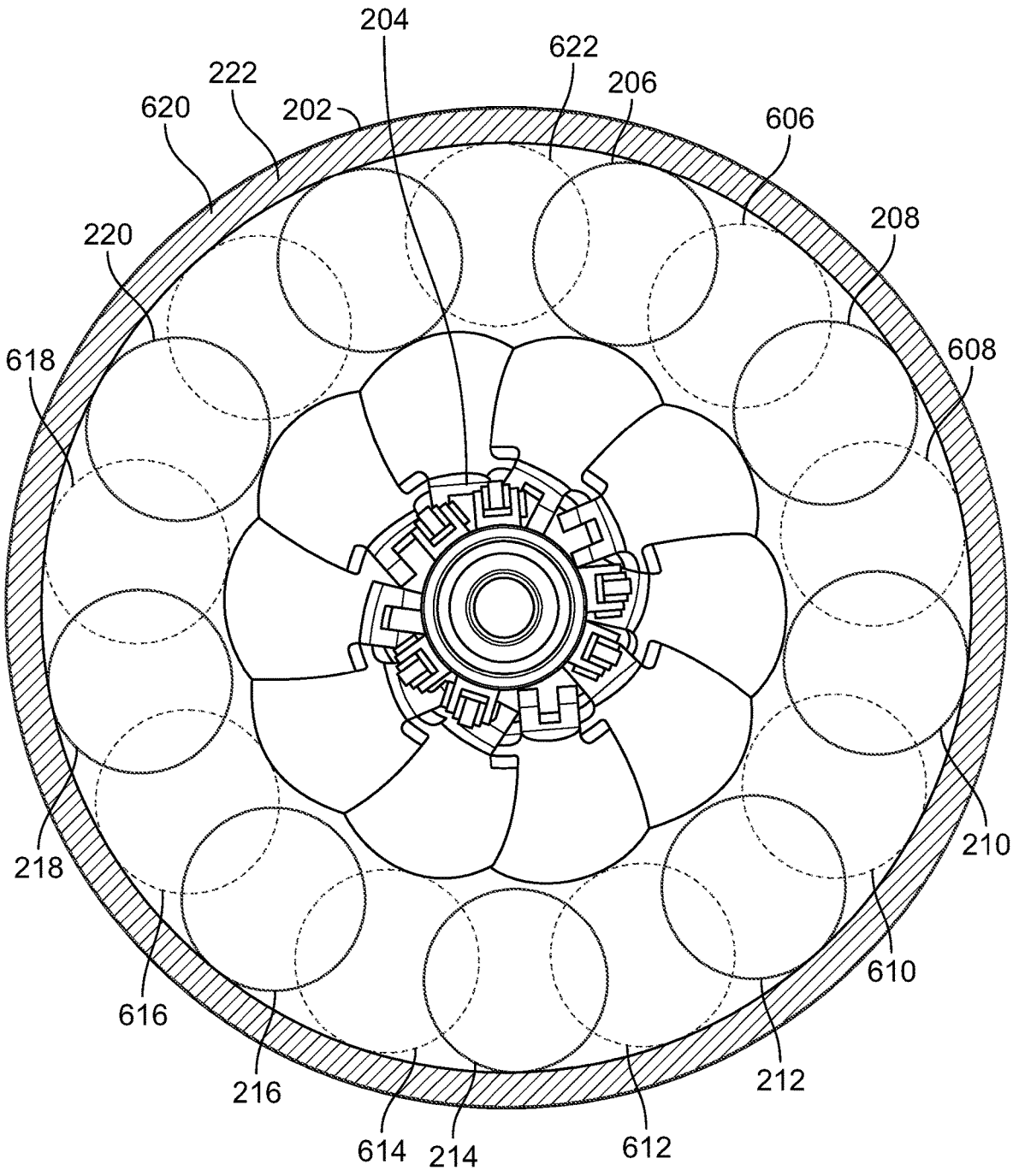
FIG. 9 depicts a cross section of two clusters of perforator guns of FIG. 7 but in an expanded position with perforator guns in one cluster being aligned at a phase offset relative to perforator guns of the other cluster, according to some embodiments.

FIG. 9 depicts a cross section of two clusters of perforator guns of FIG. 7 but in an expanded position with perforator guns in one cluster being aligned at a phase offset relative to perforator guns of the other cluster, according to some embodiments.

In this example, the equal angular spacing of the perforator guns in each of the clusters 200 and 600 remains. Also, in this example, the phase offset between the perforator guns 206-222 of the cluster 200 and the perforator guns 606-622 of the cluster 600 remains. As shown, after the perforator guns 206-222 of the cluster 200 and the perforator guns 606-622 of the cluster 600 are moved to the expanded position, the perforator guns 206-222 of the cluster 200 and the perforator guns 606-622 of the cluster 600 are in contact with the wall of the casing 202 of the wellbore. Thus, there is essentially no fluid gap 230 (depicted in FIGS. 2 and 7) remaining between the perforator guns and the target to be perforated. Also, in this example, the articulation to the expanded position causes the perforator guns in the clusters 200 and 600 to not be in contact with adjacent perforator guns.

In some instances, the perforator tool can be configured to create fluid clearances in the optimum range for a given charge and target scenario. Thus, the expanded position for each cluster can vary. For example, for a given perforator tool, perforator guns of a first cluster can be fully articulated to be in contact with the target. Whereas, perforator guns of a second cluster can be articulated half-way outward the target to allow for a different perforation, perforator guns of a third cluster can be articulated three-quarters outward the target to allow for another perforation, etc.

Example Perforator Operations

Figure 10:
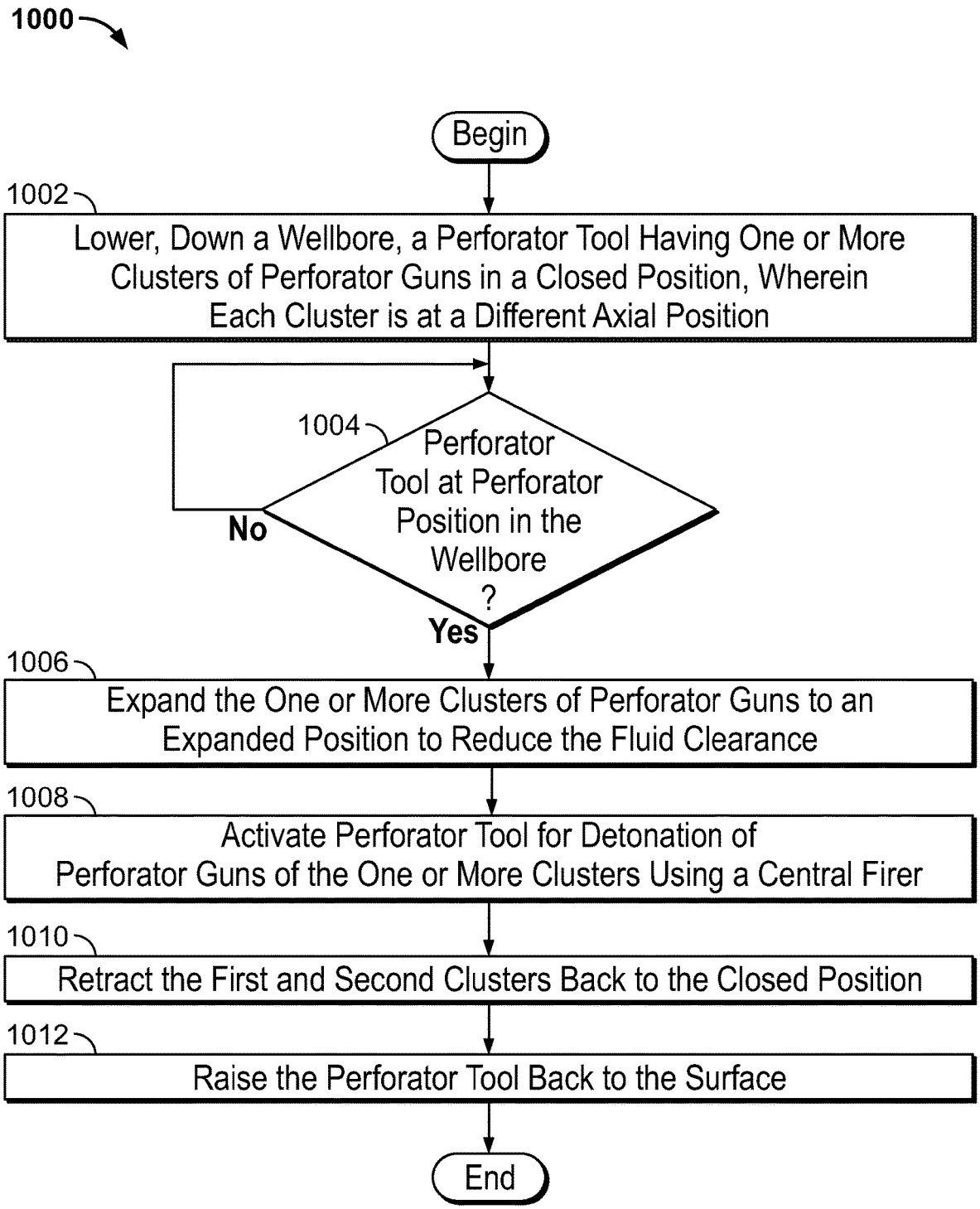
FIG. 10 depicts a flowchart for perforating a wellbore using one or more clusters of perforator guns, according to some embodiments.

FIG. 10 depicts a flowchart for perforating a wellbore using one or more clusters of perforator guns, according to some embodiments. At least some of the operations in a flowchart 1000 of FIG. 10 can be performed based on execution of program code/instructions stored in one or more machine-readable media. For example, at least some of the operations can be performed via a programmable logic controller (PLC) with electronic actuators, a hydraulic logic using a series of pistons and orifices, mechanical movement of at least one portion of the central member 204 relative to another, and any other types of downhole manipulation methods.

A perforator tool having one or more clusters of perforator guns is lowered down a wellbore (1002). The one or more clusters of perforator guns are both in a closed position. If there are multiple clusters, each cluster can be at a different non-overlapping axial position. With reference to FIG. 3, the cluster 200 in a perforator tool is lowered down the wellbore while in the closed position. With reference to FIG. 6, the perforator tool includes multiple clusters—the cluster 200 and the cluster 300—at different axial positions. The cluster 200 and the cluster 300 can be at different axial positions such that there is no overlap. The perforator guns in the cluster 200 and the perforator guns in the cluster 300 can have a same angular spacing. While having a same angular spacing, in some embodiments, the perforator guns of the cluster 300 have a phase offset to the perforator guns of the cluster 200.

A determination is made of whether the perforator tool has been lowered to a designated perforator position in the wellbore (1004). Thus, the perforator tool continues to be lowered into the wellbore until the location is reached where a perforation is to occur. With reference to FIG. 1, the perforator tool 112 is lowered down the wellbore 104 until the designated perforator position has been reached. If the perforator tool has not yet been lowered to the designated perforator position, operations remain at 1004. If the perforator tool has been lowered to the designated perforator position, operations continue at 1006.

The one or more clusters of perforator guns is expanded from the closed position to an expanded position (1006). With reference to FIG. 5, the perforator guns of the cluster 200 are expanded to the expanded position outwarded to be near or in contact with the casing 202. With reference to FIG. 8, the perforator guns of the cluster 200 and the perforator guns of the cluster 600 are expanded to the expanded position outwarded to be near or in contact with the casing 202.

The perforator tool is activated for detonation of the perforator guns of the one or more clusters to create holes in the casing, the surrounding formation, etc. (1008). Each perforator gun can include one or more explosive charges that may be triggered to detonate, perforating a casing, if present, a wall of the wellbore, forming perforation tunnels in the subterranean formation, etc. For example, each perforator gun can have an individual detonating train that initiate charges aimed outward towards the target (e.g., nearest surface of the casing). In some embodiments, a central firer is used to activate the detonation of the perforator guns. The central firer can simultaneously detonate the explosive detonating trains. Alternatively, the central firer can sequentially delay the explosive detonating trains across all perforator guns in the perforator tool, all perforator guns in one cluster, etc.

The one or more clusters can then be retracted back to the closed position (1010). With reference to FIG. 3, the cluster 200 can be retracted back from the expanded position to the closed position. With reference to FIG. 6, the clusters 200 and 600 can be retracted back from the expanded position to the closed position.

The perforator tool is raised to the surface (1012). With reference to FIG. 1, the perforator tool 112 can be moved back up the wellbore 104 to the surface.

In some situations, after detonation, the clusters can be significantly damaged, fragmented, dissolved away, etc. In these situations, the central member 204 of the perforator tool can be retrieved or dropped. Accordingly, the operations at 1010-1012 are not needed.

The flowchart is provided to aid in understanding the illustrations and are not to be used to limit scope of the claims. The flowchart depicts example operations that can vary within the scope of the claims. Additional operations may be performed; fewer operations may be performed; the operations may be performed in parallel; and the operations may be performed in a different order. For example, the operations depicted in blocks 806 and 808 can be performed in parallel or concurrently.

Example Computer

Figure 11:
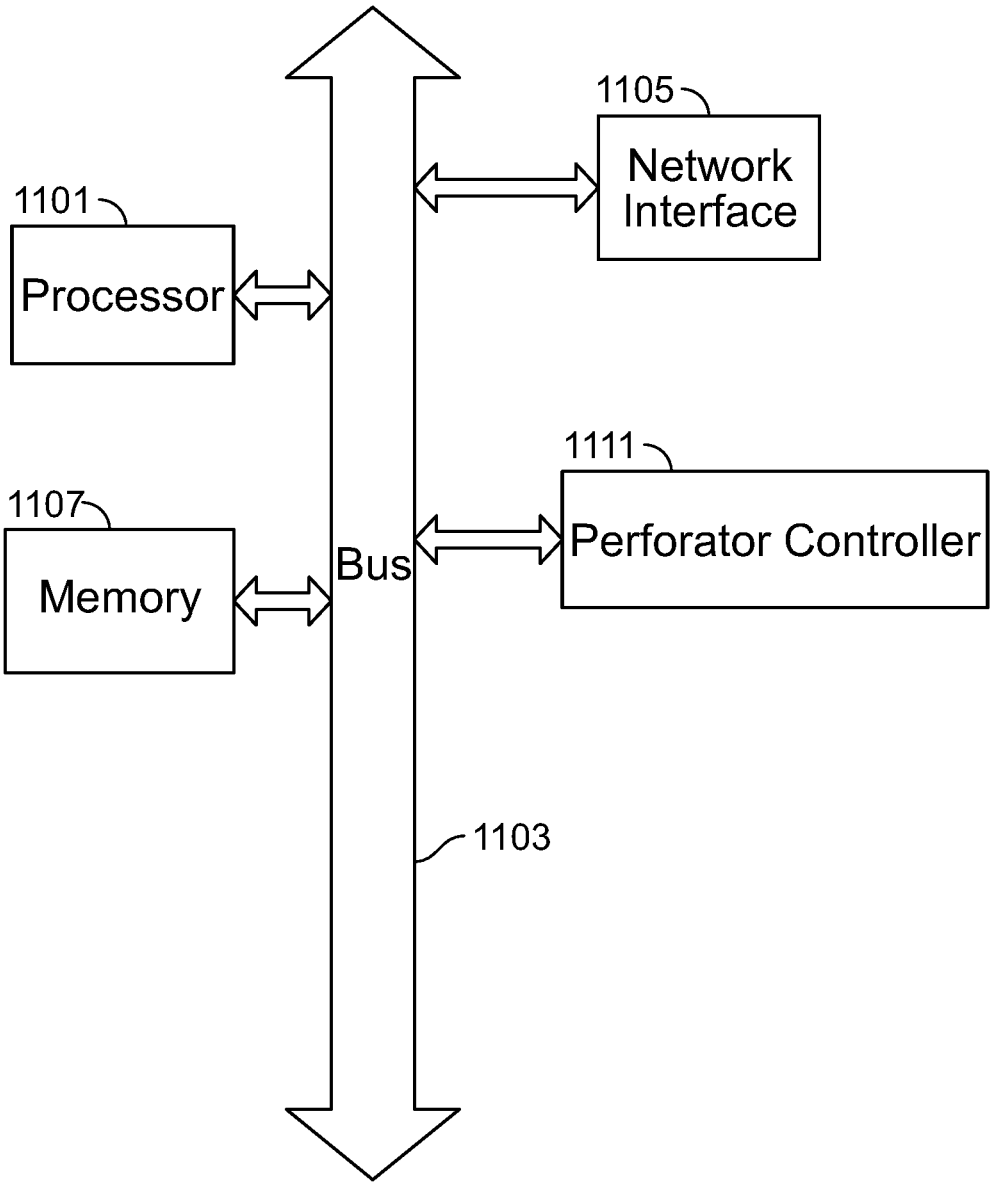
FIG. 11 depicts an example computer, according to some embodiments.

FIG. 11 depicts an example computer, according to some embodiments. The computer includes a processor 1101 (possibly including multiple processors, multiple cores, multiple nodes, and/or implementing multi-threading, etc.). The computer includes memory 1107. The memory 1107 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer system also includes a bus 1103 (e.g., PCI, ISA, PCI-Express, HyperTransport® bus, InfiniBand® bus, NuBus, etc.) and a network interface 1105 (e.g., a Fiber Channel interface, an Ethernet interface, an internet small computer system interface, SONET interface, wireless interface, etc.).

The computer also includes a perforator controller 1111. The perforator controller 1111 can perform one or more operations for controller a perforator tool (as described above). Any one of the previously described functionalities may be partially (or entirely) implemented in hardware and/or on the processor 1101. For example, the functionality may be implemented with an application specific integrated circuit, in logic implemented in the processor 1101, in a co-processor on a peripheral device or card, etc. Further, realizations may include fewer or additional components not illustrated in FIG. 11 (e.g., video cards, audio cards, additional network interfaces, peripheral devices, etc.). The processor 1101 and the network interface 1105 are coupled to the bus 1103. Although illustrated as being coupled to the bus 1103, the memory 1107 may be coupled to the processor 1101.

It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for perforation as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Embodiments

In some embodiments, an apparatus comprises a first cluster of perforator guns positioned circumferentially around a central longitudinal axis at a first axial position, wherein the first cluster is configured in a closed position while the apparatus is being lowered to a perforator position in a wellbore. After the apparatus is lowered to the perforator position, the first cluster is to move to an expanded position such that the perforator guns are moved closer to a target that is to be perforated.

In some embodiments, the perforator guns of the first cluster are aligned according to a degree phasing around the central longitudinal axis by an even division of the number of the perforator guns of the first cluster.

In some embodiments, the apparatus also includes a second cluster of perforator guns positioned circumferentially around the central longitudinal axis at a second axial position, wherein the second cluster is configured in a closed position while the apparatus is being lowered to the perforator position in the wellbore. After the apparatus is lowered to the perforator position, the second cluster is to move to an expanded position such that the perforator guns are moved closer to the target that is to be perforated.

In some embodiments, the perforator guns of the second cluster are aligned at a phase offset relative to the perforator guns of the first cluster.

In some embodiments, the perforator guns of the second cluster are aligned according to a degree phasing around the central longitudinal axis by an even division of the number of the perforator guns of the second cluster.

In some embodiments, each perforator gun of the first and second clusters includes at least one explosive charge to be detonated.

In some embodiments, each perforator gun has an explosive train that is to trigger the at least one explosive charge and that is independent of explosive trains of the other perforators guns.

In some embodiments, the explosive trains of the perforator guns are to be simultaneously triggered from a central firer.

In some embodiments, each explosive train of the perforator guns are sequentially delayed.

In some embodiments, the perforator guns of the first and second clusters are in contact with a central member positioned along the central longitudinal axis while in the closed position. In the first cluster, each perforator gun is in contact with at least one other perforator gun while in the closed position. In the second cluster, each perforator gun is in contact with at least one other perforator gun while in the closed position.

In some embodiments, after the apparatus is lowered to the perforator position, the first and second clusters are to move to the expanded position such that the perforator guns are moved to be in contact with the target that is to be perforated. In some embodiments, the target comprises at least one of a casing of the wellbore and a surrounding formation.

In some embodiments, an apparatus includes a perforator tool having a central longitudinal axis for placement in a wellbore extending through a subterranean formation. The perforator tool includes a central member positioned along the central longitudinal axis. The perforator tool also includes a first cluster of perforator guns positioned circumferentially around the central longitudinal axis and at a first axial position. The perforator tool includes a second cluster of perforator guns positioned circumferentially around the central longitudinal axis. The perforator guns of the first and second clusters have explosive charges to perforate at least one of a downhole tubular in the wellbore and the subterranean formation. The first and second clusters are to circumscribe a first radial position until the perforator tool is lowered down the wellbore to a perforator position. After the perforator tool is lowered to the perforating position, the first and second clusters of perforator guns are to expand to a second radial position having a diameter that is larger than the first radial position prior to the perforation.

In some embodiments, the perforator guns of the first and second clusters are aligned according to a degree phasing around the central longitudinal axis by an even division of the number of the perforator guns of the first cluster.

In some embodiments, the perforator guns of the second cluster are aligned at a phase offset relative to the perforator guns of the first cluster.

In some embodiments, each perforator gun of the first and second clusters includes at least one explosive charge to be detonated and an explosive train that is to trigger the at least one explosive charge and that is independent of explosive trains of the other perforators guns.

In some embodiments, the perforator guns of the first and second clusters are in contact with the central member while in the first radial position. In the first cluster, each perforator gun is in contact with at least one other perforator gun while in the first radial position. Also, in the second cluster, each perforator gun is in contact with at least one other perforator gun while in the first radial position. After the apparatus is lowered to the perforator position, the first and second clusters are to move to the second radial position such that the perforator guns are moved to be in contact with a target that is to be perforated. The target includes at least one of a casing of the wellbore and a surrounding formation.

In some embodiments, a method includes lowering a perforator tool down a wellbore to a perforator position, wherein the perforator tool comprises a first cluster of perforator guns in a closed position at a first axial position and positioned circumferentially around a central longitudinal axis. In response to the perforator tool being lowered to the perforator position in the wellbore, the first cluster of perforator guns is moved from the closed position to an expanded position such that the perforator guns are positioned closer to a target to be perforated. Also, in response to the perforator tool being lowered to the perforator position in the wellbore, the wellbore is perforated based on detonation of the perforator guns.

In some embodiments, the perforator tool comprises a second cluster of perforator guns. The perforator guns of the first cluster are at a phase offset relative to the perforator guns of the second cluster in the closed position.

In some embodiments, a central member is positioned along the central longitudinal axis for the perforator tool, wherein the perforator guns of the first cluster and the perforator guns of the second cluster are in contact with the central member while in the closed position.

In some embodiments, in the first cluster, each perforator gun is in contact with at least one other perforator gun while in the closed position. Also, in the second cluster, each perforator gun is in contact with at least one other perforator gun while in the closed position.

Additional embodiments can include varying combinations of features or elements from the example embodiments described above. For example, one embodiment may include elements from three of the example embodiments while another embodiment includes elements from five of the example embodiments described above.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

What is claimed is:

1. An apparatus comprising:

a central member positioned along a central longitudinal axis and having one or more diametrically expandable tools; and a first cluster of perforator guns positioned circumferentially around and coupled to a first diametrically expandable tool of the one or more diametrically expandable tools at a first axial position along the central member, wherein the first cluster is configured in a closed position while the apparatus is being lowered to a perforator position in a wellbore, wherein, in the closed position, the perforator guns of the first cluster are in contact with the central member, wherein, based on a determination that the apparatus is lowered to the perforator position, expansion of the first diametrically expandable tool of the central member is to move the first cluster from the closed position to an expanded position such that the perforator guns are moved closer to a target that is to be perforated; and a second cluster of perforator guns positioned circumferentially around the one or more diametrically expandable tools at a second axial position, wherein expansion of the second cluster of perforator guns is independent of expansion of the first cluster of perforator guns.

2. The apparatus of claim 1, wherein the perforator guns of the first cluster are aligned according to a degree phasing around the central longitudinal axis by an even division of a number of the perforator guns of the first cluster.

3. The apparatus of claim 2, wherein perforator guns of the second cluster of perforator guns do not axially overlap with perforator guns of the first cluster of perforator guns, wherein the second cluster is configured in the closed position while the apparatus is being lowered to the perforator position in the wellbore, and wherein, based on a determination that the apparatus is lowered to the perforator position, expansion of a second diametrically expandable tool is to move the second cluster to the expanded position such that the perforator guns are moved closer to the target that is to be perforated.

4. The apparatus of claim 3, wherein the perforator guns of the second cluster are aligned at a phase offset relative to the perforator guns of the first cluster.

5. The apparatus of claim 4, wherein the perforator guns of the second cluster are aligned according to a degree phasing around the central longitudinal axis by an even division of the number of the perforator guns of the second cluster.

6. The apparatus of claim 3, wherein each perforator gun of the first and second clusters includes at least one explosive charge to be detonated.

7. The apparatus of claim 6, wherein each perforator gun has an explosive train that is to trigger the at least one explosive charge and that is independent of explosive trains of the other perforator guns.

8. The apparatus of claim 7, wherein the explosive trains of the perforator guns are to be simultaneously triggered from a central firer.

9. The apparatus of claim 7, wherein each explosive train of the perforator guns are sequentially delayed.

10. The apparatus of claim 3, wherein, in the first cluster, each perforator gun is in contact with at least one other perforator gun while in the closed position, and wherein, in the second cluster, each perforator gun is in contact with at least one other perforator gun while in the closed position.

11. The apparatus of claim 3, wherein after the apparatus is lowered to the perforator position, expansion of the diametrically expandable tool of the central member is to move the first and second clusters to the expanded position such that the perforator guns are in contact with the target that is to be perforated, and wherein the target comprises at least one of a casing of the wellbore and a surrounding formation.

12. An apparatus comprising:

a perforator tool having a central longitudinal axis for placement in a wellbore extending through a subterranean formation, the perforator tool comprising, a central member positioned along the central longitudinal axis a plurality of diametrically expandable tools;

a first cluster of perforator guns positioned circumferentially around the central member and coupled to a first diametrically expandable tool of the plurality of diametrically expandable tools; and a second cluster of perforator guns positioned circumferentially around the central member and coupled to a second diametrically expandable tool of the plurality of diametrically expandable tools, wherein the second cluster of perforator guns does not axially overlap with the first cluster of perforator guns, the perforator guns of the first and second clusters having explosive charges to perforate at least one of a downhole tubular in the wellbore and the subterranean formation, wherein the first and second clusters are to circumscribe a first radial position until the perforator tool is lowered down the wellbore to a perforator position, wherein, based on a determination that the perforator tool is lowered to the perforating position, expansion of the first diametrically expandable tool of the central member is to move the first cluster of perforator guns to a first expanded position and expansion of the second diametrically expandable tool of the central member is to move the second cluster of perforator guns to a second expanded position, wherein the first and second expanded positions have diameters larger than a diameter of the first radial position prior to perforation and wherein the first diametrically expandable tool and the second diametrically expandable tool are independently expandable.

13. The apparatus of claim 12, wherein the perforator guns of the first and second clusters are aligned according to a degree phasing around the central longitudinal axis by an even division of a number of the perforator guns of the first cluster.

14. The apparatus of claim 13, the perforator guns of the second cluster are aligned at a phase offset relative to the perforator guns of the first cluster.

15. The apparatus of claim 12, wherein each perforator gun of the first and second clusters includes at least one explosive charge to be detonated and an explosive train that is to trigger the at least one explosive charge and that is independent of explosive trains of the other perforator guns.

16. The apparatus of claim 12, wherein the perforator guns of the first and second clusters are in contact with the first and second diametrically expandable tools of the central member, respectively, while in the first radial position, wherein, in the first cluster, each perforator gun is in contact with at least one other perforator gun while in the first radial position, and wherein, in the second cluster, each perforator gun is in contact with at least one other perforator gun while in the first radial position.

17. A method comprising:

lowering a perforator tool down a wellbore to a perforator position, wherein the perforator tool comprises:

a central member positioned along a central longitudinal axis of the perforator tool and having one or more expandable sections;

a first cluster of perforator guns in a closed position at a first axial position and positioned circumferentially around the central member, wherein the first cluster of perforator guns is coupled to a first expandable section of the one or more expandable sections of the central member, and a second cluster of perforator guns in a closed position at a second axial location and positioned circumferentially around the central member, wherein perforating guns of the first cluster of perforator guns does not axially overlap with perforator guns of the second cluster of perforator guns;

in response to the perforator tool being lowered to the perforator position in the wellbore, based on a determination that the perforator tool is positioned at the perforator position, expanding the first expandable section of the central member to move the first cluster of perforator guns from the closed position to an expanded position such that perforator guns of the first cluster of perforating guns are positioned closer to a target to be perforated, wherein the first cluster of perforator guns is movable independent of the second cluster of perforator guns; and perforating the wellbore based on detonation of the perforator guns of the first cluster of perforating guns.

18. The method of claim 17, wherein the perforator guns of the first cluster are at a phase offset relative to perforator guns of the second cluster in the closed position.

19. The method of claim 17, further comprising:

expanding a second expandable section of the one or more expandable sections of the central member to move the perforator guns of the second cluster from the closed position to an expanded position such that perforator guns of the second cluster of perforating guns are positioned closer to the target to be perforated, wherein the perforator guns of the second cluster are in contact with the second expandable section of the central member while in the closed position.

20. The method of claim 19, wherein, in the first cluster, each perforator gun is in contact with at least one other perforator gun while in the closed position, and wherein, in the second cluster, each perforator gun is in contact with at least one other perforator gun while in the closed position.

* * * * *